US007007928B2

(12) United States Patent
Van Cor

(10) Patent No.: US 7,007,928 B2
(45) Date of Patent: Mar. 7, 2006

(54) TIRE WINCH, TIRE WINCH KIT AND METHOD

(76) Inventor: Dale E. Van Cor, 201 S. Parrish Rd., Winchester, NH (US) 03470

( * ) Notice: Subject to any disclaimer, the term of this patent is extended or adjusted under 35 U.S.C. 154(b) by 31 days.

(21) Appl. No.: 10/695,885

(22) Filed: Oct. 29, 2003

(65) Prior Publication Data

US 2004/0084663 A1 May 6, 2004

Related U.S. Application Data

(60) Provisional application No. 60/422,171, filed on Oct. 29, 2002.

(51) Int. Cl.
*B66D 1/00* (2006.01)

(52) U.S. Cl. ..... 254/323; 242/392

(58) Field of Classification Search ..... 254/323; 242/392; 180/7.5, 53.61
See application file for complete search history.

(56) References Cited

U.S. PATENT DOCUMENTS

| | | | | | |
|---|---|---|---|---|---|
| 1,165,510 | A | * | 12/1915 | Anderson et al. | 242/392 |
| 1,287,620 | A | * | 12/1918 | Benson | 242/392 |
| 1,463,022 | A | * | 7/1923 | Sepelyak | 242/392 |
| 1,469,506 | A | * | 10/1923 | Gillam | 242/392 |
| 1,526,206 | A | * | 2/1925 | Dominguez | 242/392 |
| 2,240,570 | A | * | 5/1941 | Oesterheld | 242/392 |
| 2,377,881 | A | * | 6/1945 | Hans | 242/392 |
| 2,751,193 | A | * | 6/1956 | Loomis | 242/392 |
| 3,099,416 | A | * | 7/1963 | Wright | 242/392 |
| 3,132,823 | A | * | 5/1964 | Domines | 242/392 |
| 3,292,905 | A | * | 12/1966 | McCain | 242/392 |
| 4,135,681 | A | * | 1/1979 | Cooper | 242/392 |
| 4,291,847 | A | * | 9/1981 | Gilbert | 242/392 |
| 4,568,036 | A | * | 2/1986 | Kearney | 242/392 |
| 4,742,971 | A | * | 5/1988 | Wallace et al. | 242/392 |
| 4,778,126 | A | * | 10/1988 | Spann, Jr. | 242/392 |
| 4,836,466 | A | * | 6/1989 | Peterson | 242/392 |
| 5,115,994 | A | * | 5/1992 | Hershberger | 242/392 |
| 5,228,661 | A | * | 7/1993 | Bigham et al. | 254/276 |
| 5,251,877 | A | * | 10/1993 | Rempinski et al. | 254/323 |
| 5,415,377 | A | * | 5/1995 | Britt et al. | 254/323 |
| 5,890,671 | A | * | 4/1999 | Meloy | 242/392 |
| 6,375,110 | B1 | * | 4/2002 | Ofer et al. | 242/392 |

* cited by examiner

*Primary Examiner*—Emmanuel Marcelo
(74) *Attorney, Agent, or Firm*—Michael J. Persson; Lawson & Persson, P.C.

(57) ABSTRACT

A tire winch, tire winch kit, and method of pulling an object. The tire winch includes a spool having a substantially cylindrical hub dimensioned to accept and wind a cable thereabout, and a means for attaching the spool to a tire such that the rotation of the tire causes the spool to rotate. The kit includes a winding spool, an unwinding spool and a means for attaching one of the spools to the tire. The method includes the steps of attaching the winch to a drive wheel of a vehicle, winding a flexible member around the hub of the winch, attaching the free end of the member to an object, and driving away from the object to unwind the member from the winch and, thereby, pull the object a distance that is less than the distance traveled by the vehicle.

12 Claims, 18 Drawing Sheets

Mechanical Advantage as Function of Hub Diameter
Winding vs. Unwinding

TIRE WINCH, TIRE WINCH KIT AND METHOD

CLAIM OF PRIORITY

This application claims the benefit of priority of U.S. Provisional Patent Application Ser. No. 60/422,171 filed on Oct. 29, 2002.

FIELD OF THE INVENTION

The present invention relates to the field of pulling devices and, in particular, to tire winches, tire winch kits and methods for pulling an object a relatively short distance using a vehicle.

BACKGROUND OF THE INVENTION

It is commonplace for an automobile, truck, and other wheeled vehicle to leave a paved roadway and lose tire traction, resulting in spinning wheels that leave the vehicle immovable under its own power. In cases where the vehicle is relatively light and has multiple occupants, it is often possible for the passengers to push the vehicle a short distance, allowing the wheels to regain traction. However, lone drivers, or those with relatively heavy vehicles, are typically not able to move the vehicle even the short distance that is required to regain traction. Drivers stuck in this predicament have typically been forced to call a tow truck to pull them out, resulting in lost time and, often, significant out of pocket expense. Further, in cases where emergency vehicles, such as ambulances, fire trucks, and police cars, are stuck, the time required for a tow truck to arrive may result in far greater consequences than boredom and lost productivity.

Because of the inability of a tow truck to reach stranded off-road vehicles, it is commonplace for off-road vehicles, such as four-wheel drive pickup trucks, to be equipped with an electric or hydraulic winch. In the event that the vehicle is stuck, the winch wire is secured to a fixed or heavy object, such as a tree or other vehicles, and the winch is wound, effectively pulling the vehicle the required distance. However, because most drivers do not drive off-road and do not have a frequent need for a winch, the vast majority of vehicles are not equipped with a winch. Further, the cost of a winch, and the need to retrofit a vehicle to accept it, effectively precludes the purchase and use of an attachable winch that could be stored in the trunk of a passenger vehicle.

Yet another way to pull a vehicle a short distance is to use a ratcheting mechanical device, often called a "come along". These devices typically include a metal cable that is secured to a fixed or heavy object, such as a tree or other vehicles, and wound around a hub through the actuation of a lever. When used properly, these devices are sufficient to move a relatively light vehicle the necessary distance and, unlike a winch require no retrofitting and are adapted for storage in the trunk of a passenger vehicle. However, these devices have significant drawbacks. For example, the fact that a come along is hand actuated means that most drivers will not be able to actuate the lever to pull heavy vehicles, and many drivers would be unable to move even the lightest of vehicles. Further, the need for the driver to be located outside of vehicle and proximate to the cable results in a significant risk of personal injury in the event that the device malfunctions or the cable breaks.

Another way to pull a vehicle a short distance is to attach a rope or cable to another vehicle and use the power of that vehicle to pull the stranded vehicle the distance required to regain traction. This method is fairly effective in circumstances where the towing vehicle has excellent traction and sufficient power to pull both vehicles. However, in cases where traction is poor, such as on the snow or ice that often will be the cause of the stranded vehicle leaving the roadway, it is often impossible to generate the force required to propel both the towing vehicle and the stranded vehicle the required distance.

Still another way to pull a vehicle a short distance is described in U.S. Pat. Nos. 1,165,510, 1,526,206, 3,099,416, 3,123,823, and 6,375,110, which each describe variations of wheel operated winch attachments. All of these attachments to vehicle wheels are attached to the stuck vehicle in order to pull them out of the mud or snow, and include a drum or cage or bolted on brackets that mimic a drum. In each, the drums are small relative to the wheel, which creates an inherent mechanical advantage where several rotations of the drum would be equal to one rotation of the wheel with proper traction, providing a mechanical advantage in winding. However, each has distinct drawbacks that make them impractical as towing winches and, hence, ineffective in cases where there is no fixed object upon which to attach the line.

First, when attached to a towing vehicle in the manner described in each patent, the use of the spool creates a mechanical disadvantage; i.e. it takes more torque to pull the stuck vehicle as the distance of line wound onto the winch is added to the distance traveled by the towing vehicle. Second, by towing in this manner, the distance between vehicles is diminishing the further the towed vehicle is pulled, running the risk of a collision. Finally, none of these winches has any torque-limiting means to prevent over-torqueing of the wheels, which can create a significant safety hazard from snapped lines and both safety and damage hazards from the unintended disengagement to the winch from the wheel.

Therefore, there is a need for an apparatus and/or system that will pull a vehicle a relatively short distance, that does not require permanent installation on, or retrofitting of, a vehicle, that is significantly less expensive than winches, that is readily storable in the trunk of a passenger car, that may be quickly and easily mounted to a vehicle, that reduces the risk of personal injury by locating the driver in the vehicle during operation, that may be effectively used by all drivers of heavy or light vehicles, that is readily adapted to provide a mechanical advantage in towing applications, and provides at least one safety mechanism that prevents excessive force from being exerted upon the system.

SUMMARY OF THE INVENTION

The present invention is a tire winch system, kit and method that overcomes the drawbacks inherent in the prior art. In its most basic form, the tire winch includes a spool having a substantially cylindrical hub dimensioned to accept and wind a cable, rope or strap thereabout, and a means for attaching the spool to a tire such that the rotation of the tire causes the spool to rotate. The basic embodiment of the system includes the tire winch and a cable, such as a rope, braided metal wire or other art recognized means for pulling that is sufficiently flexible to wind about the hub of the spool and sufficiently strong to withstand the forces applied by the system.

The tire winch may be utilized in two distinct ways. In each, the tire winch is mounted to a drive wheel of a vehicle and a cable is attached either to a fixed object, or to the stranded vehicle to be pulled. In cases where the tires of the stranded vehicle are spinning, such as on snow or ice, the cable is wound about the hub only enough to secure it thereto, and the drive wheels are spun, causing the cable to wind about the hub and pull the vehicle toward the fixed object. When the tire regains traction, the cable goes limp, as the circumference of the tire is greater than that of the spool, allowing the driver to continue moving forward to safety without unhooking the cable from the object. It is recognized that this method is old in the art and, therefore, is not considered to be part of the present invention. However, this means of operation may be utilized in connection with the kit embodiments of the invention, described below, and therefore has been mentioned here.

In cases where a second vehicle is present, the method of the present invention is utilized. Using this method, the tire winch is attached to one of the wheels of the second vehicle and one end of the flexible pulling member is attached to the stranded vehicle while the other is fully wound around the hub of the tire winch. The driver will then drive forward, causing the cable to unwind from the spool. However, because the circumference of the spool is less than the circumference of the tire, the cable will unwind at a slower rate than the vehicle is moving forward, creating a pulling force on the stranded vehicle that causes the vehicle to move a shorter distance than is traveled by the towing vehicle. Because the distance traveled is reduced, the force that needs to be generated by the tires of the towing vehicle is significantly less than would be required if the both vehicles had to travel the same distance. Further, as the distance between the vehicles is increasing rather than decreasing, it eliminates the risk of pulling the towed vehicle into the towing vehicle, increasing safety.

In one preferred embodiment of the tire winch, the spool is attached to a separate attachment means that includes torque-limiting means. In these embodiments, the maximum torque to be applied to the system is set by the torque-limiting means, either by the user or at the factory, and the spool will spin freely about the hub when over-torqued. In some such embodiments, the torque limiting means is a ratcheting system similar to those employed in standard torque wrenches. However, in others, the torque limiting means uses a frictional engagement between the spool and attachment means that will break free and rotate when the maximum pre-set torque is reached. It is recognized that the torque limiting means is applicable to both winding and unwinding applications and, therefore, embodiments utilizing this feature should not be seen as limited to one particular method of use.

Other preferred embodiments of the tire winch include spools that are sized to provide at least an average 2:1 mechanical advantage in unwinding mode. In these embodiments, the spool is sized to be at least 40% of the diameter of the tire to which it attaches, and preferably is sized to be larger.

In some embodiments of the invention, the tire winch attaches directly to the wheel of a vehicle by removing two or more lug nuts, aligning holes in the central portion of the tire winch with the lugs, and tightening the lug nuts down over the central portion to secure the winch thereto. In other embodiments, the tire winch is removably attached to a special rim that has details adapted to allow the winch to quickly be attached and removed thereto. In still others, a specialized adapter is affixed to a standard rim, providing the same quick connect/disconnect advantage without the need to purchase a specialized replacement rim.

Finally, in some embodiments of the invention, the tire winch system is provided in kit form. The most basic embodiment of the kit includes two spools and an attachment means that is dimensioned to attach either of the spools to a tire. The first spool is a winding spool that is dimensioned to have a diameter that is less than 40% of the diameter of the tire. The second spool is an unwinding spool that is dimensioned to have a diameter that is greater than 40% of the diameter of the tire. In the preferred embodiment of the kit, the flexible pulling member is provided. It is preferred that this pulling member be a flexible strap that winds over itself and is secured by the frictional contact of one wind of the strap onto another, although ropes, cables or other members that are sufficiently flexible to wrap about the hub and sufficiently strong to handle the loads placed upon the member by the system, may be utilized. In some embodiments of the kit, a carrying case and instructions for use are likewise provided.

A broad variety of vehicles can utilize the tire winch and system of the present invention, including farm tractors, trucks, automobiles, bulldozers or tanks, or any other vehicle having a source of rotation to which the tire winch may be attached. It is envisioned that the winch and system will have the greatest impact on emergency vehicles, such as fire trucks, police cars, ambulances and the like.

Though mainly identified as a means of getting out a vehicle stuck in the mud or snow, the present invention allows a user to use the vehicle's power to displace many objects. Particularly in the unwinding embodiment of the present invention, because you are driving away from the object, there is an inherent safety. Off-road vehicles could pull fallen trees out of the way. Hunters could move a dead moose or bear a short distance, then rewind and move again. Loggers could get their skidder, bulldozer or truck unstuck. Further, it is recognized that other problems previously solved with traditional winches and come-alongs can generally be solved with the present invention.

Therefore, it is an aspect of the present invention to provide an apparatus, system and kit for pulling a vehicle a relatively short distance.

It is a further aspect of the present invention to provide an apparatus, system and kit for pulling a vehicle a relatively short distance that does not require permanent installation on, or retrofitting of, a vehicle.

It is a further aspect of the present invention to provide an apparatus, system and kit for pulling a vehicle a relatively short distance that is significantly less expensive than winches.

It is a further aspect of the present invention to provide an apparatus, system and kit for pulling a vehicle a relatively short distance that is readily storable in the trunk of a passenger car.

It is a further aspect of the present invention to provide an apparatus, system and kit for pulling a vehicle a relatively short distance that is easily mounted to a vehicle.

It is a further aspect of the present invention to provide an apparatus, system and kit for pulling a vehicle a relatively short distance that reduces the risk of personal injury by locating the driver in the vehicle during operation.

It is a further aspect of the present invention to provide an apparatus, system and kit for pulling a vehicle a relatively short distance that may be quickly deployed.

It is a further aspect of the present invention to provide an apparatus, system and kit for pulling a vehicle a relatively short distance that may be effectively used by all drivers of heavy or light vehicles.

It is a further aspect of the present invention to provide an apparatus, system and kit for pulling a vehicle a relatively short distance that is readily adapted to provide a mechanical advantage in towing applications.

It is a further aspect of the present invention to provide an apparatus, system and kit for pulling a vehicle a relatively short distance that provides at least one safety mechanism that prevents excessive force from being exerted upon the system.

It is a further aspect of the present invention to provide a method for pulling an object a relatively short distance that provides a mechanical advantage over direct-pull methods.

It is a still further aspect of the present invention to provide a method for pulling an object a relatively short distance that is safer than other known methods.

These aspects of the invention are not meant to be exclusive and other features, aspects, and advantages of the present invention will be readily apparent to those of ordinary skill in the art when read in conjunction with the following description, and accompanying drawings.

DETAILED DESCRIPTION OF THE INVENTION

Figure 1:
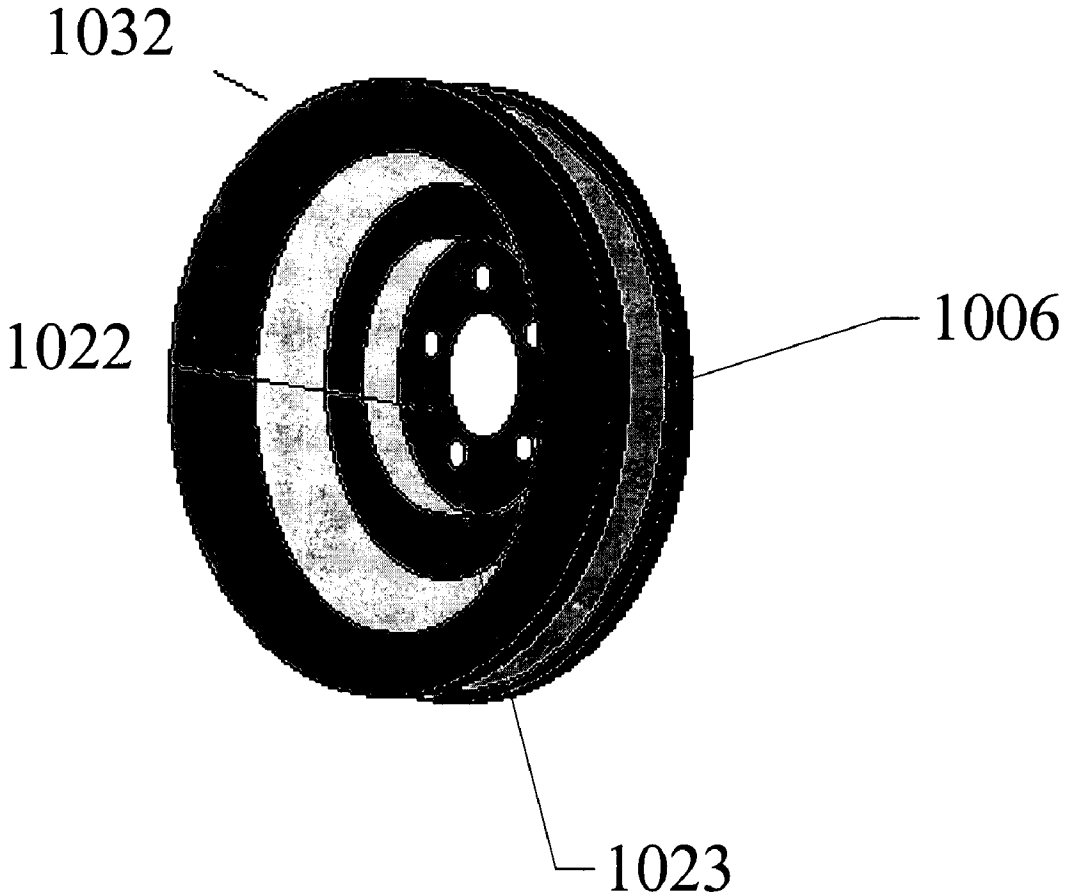
FIG. 1 is an isometric view of the hub-mounted spool of one embodiment of the tire winch of the present invention.
Figure 2:
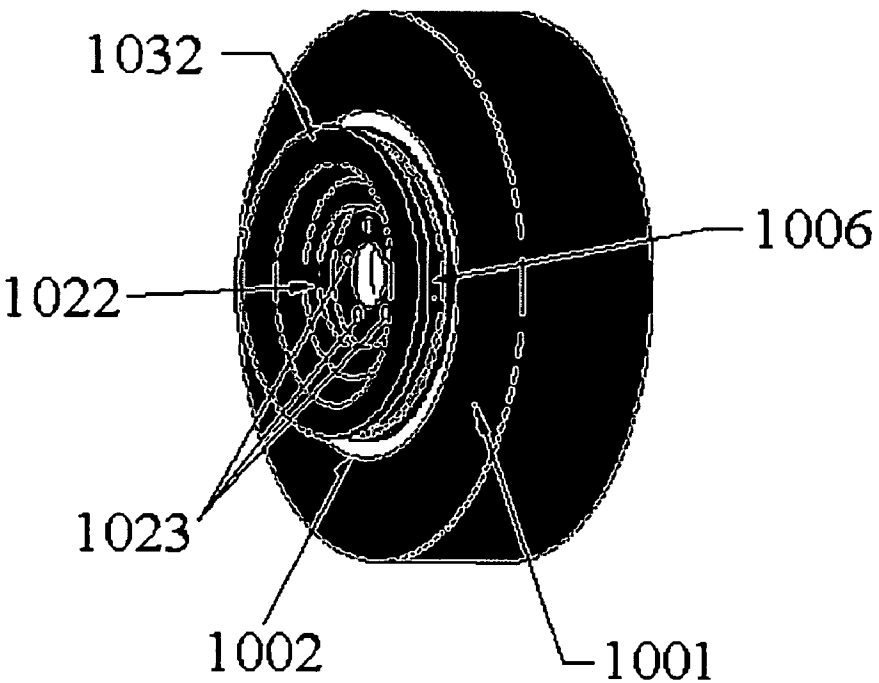
FIG. 2 is an isometric view of the hub-mounted spool of FIG. 1 mounted to a tire.

Referring first to FIGS. 1 and 2, one embodiment of a hub-mounted spool 1032 is shown. The hub-mounted spool 1032 includes a substantially cylindrical outer hub 1006 that is dimensioned to accept and wind a cable thereabout. A central portion 1022 is dimensioned to fit over the rim 1002 of a tire 1001 and includes a plurality of holes 1023 therethrough that are dimensioned and positioned to mate with lug bolts (not shown) that extend from the wheel of the vehicle (not shown). In this embodiment, the central portion 1022 and holes 1023 serve as the means for attaching the spool 1032 to a tire 1001 such that the rotation of the tire 1001 causes the spool 1032 to rotate. However, this means may take many forms. For example, in some embodiments, this means is one of the toothed means described below in connection with the quick connecting versions of the system. In others, only two holes are provided, allowing the spool to be attached without removing all lug nuts. In still others, the holes 1023 are replaced with extending tabs (not shown) that mate with and engage slots (not shown) disposed within the rim 1002 of the tire 1001.

Figure 3A:
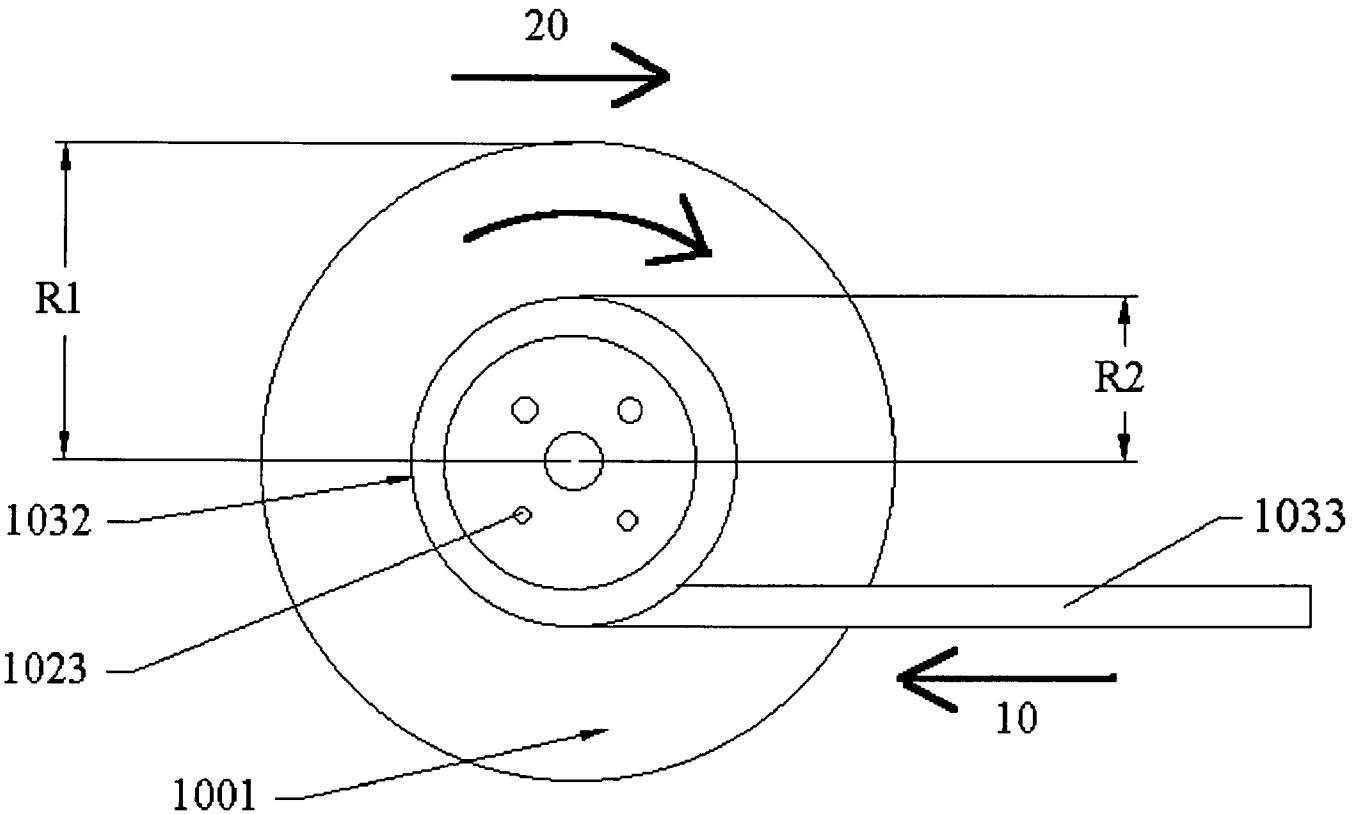
FIG. 3A is a side view showing the operation of the tire winch system when used to pull the vehicle by winding the cable about the spool.
Figure 3B:
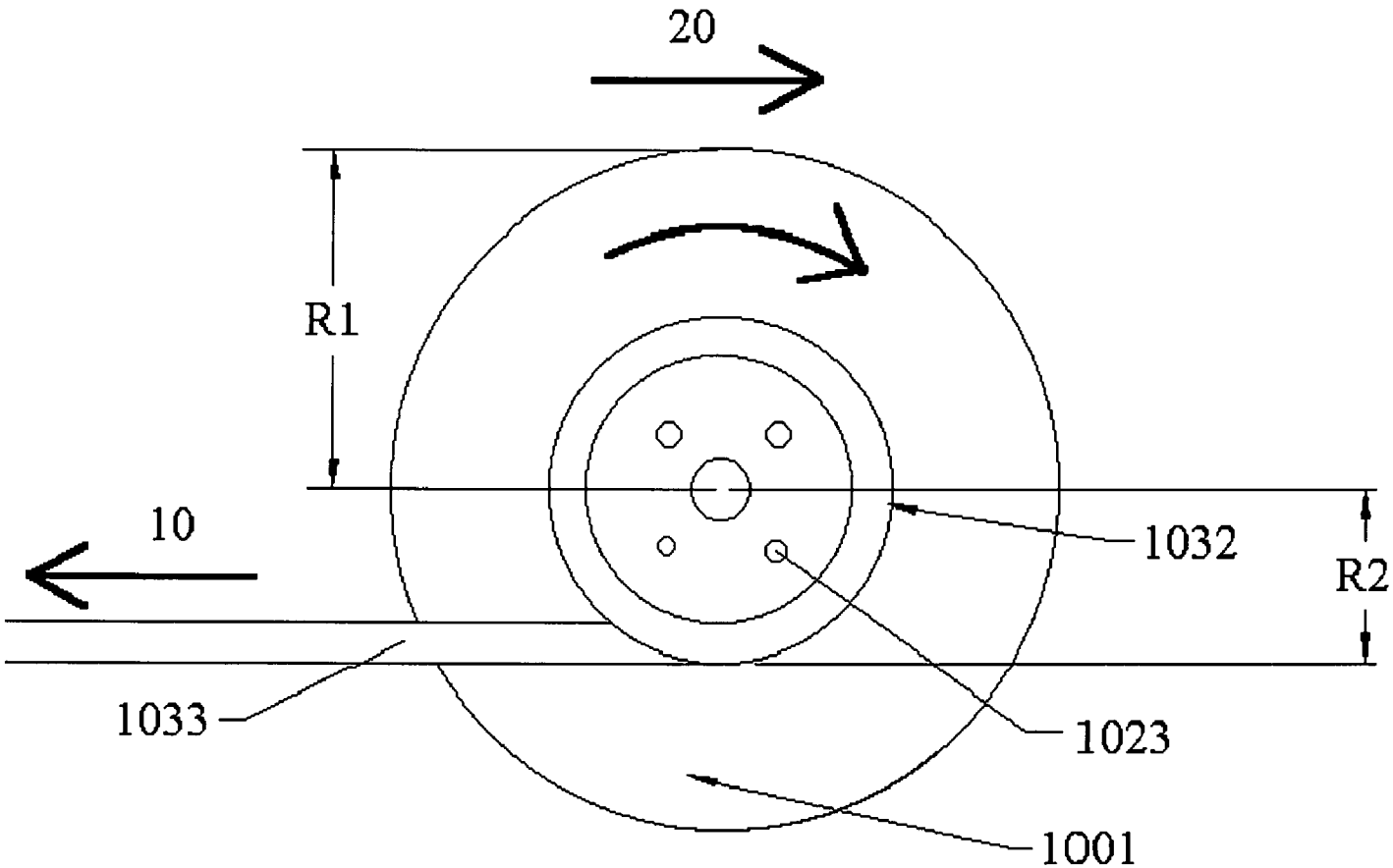
FIG. 3B is a side view showing the operation of the tire winch system when used to pull the vehicle by unwinding the cable from the spool.

Referring to FIGS. 3A and 3B, the two modes of operation are demonstrated. FIG. 3A shows the tire winch system disposed to a pull the vehicle by winding of the cable 1003. The tire winch 1032 is mounted to a tire 1001 and one end of the cable 1033 is attached to a fixed object (not shown). The other end of the cable 1033 is then attached to the hub 1006 of the spool 1032. This is preferably accomplished by simply winding the cable 1033 over itself in a manner similar to fishing line wound about a reel. However, some embodiments include a means for affixing the cable 1033 to the hub 1006, such as a clamp for clamping the cable or a hole through the hub through which the cable 1033 may be inserted and tied off. The tire 1001 is then rotated in the direction of arrow 30, causing the cable 1033 to travel in direction 10 and wind about the hub 1006, pulling the vehicle in direction 20 toward the fixed object. When the tire 1001 regains traction, the cable 1003 goes limp, as the radius of the tire R1 is greater than the radius R2 of the hub 1003 of the spool 1032, allowing the driver to continue moving forward to safety without unhooking the cable 1033 from the object.

For reasons that will be explained in more detail later in this description, the pictured embodiment of FIG. 3A displays a winding spool embodiment of the present invention. The winding spool embodiment of the tire winch system includes a spool 1032 having a spool to tire diameter ratio in the range of approximately 50% or less. Spools in this 50% or less range are considered to be effectively dimensioned to wind a line and free a light vehicle.

As shown in FIG. 3B, the tire winch 1032 is again mounted to a tire 1001, but this time is mounted to a tire 1001 of a towing vehicle. The cable 1033 is attached at one end to the stranded vehicle (not shown) while the other end is wound about the hub 1006 of the spool 1032 until most of the slack is removed from the cable. The tire 1001 is then rotated in direction 30, causing the tire to move in direction 20 and the cable 1033 to unwind in direction 10. However, because the radius R1 of the tire 1001 is greater than the radius R2 of the winch 1032, the length of cable 1033 unwound during each rotation of the tire 1001 is less than the distance traveled by the tire 1001. Accordingly, the cable 1033 exerts a force upon the stranded vehicle that causes it to likewise move in direction 20.

The distance that the stranded vehicle is moved is inversely proportional to the ratio of radius R2 to radius R1. Accordingly, a tire winch 1032 having a radius R2 that is almost as large as radius R1 will pull the stranded vehicle a very short distance, requiring a very small additional force. Conversely, a tire winch 1032 having a radius R2 that is very small compared to radius R1 will pull the stranded vehicle a longer distance, requiring a larger additional force. Regardless of the radius R2 of the tire winch 1032, however, the force required to pull the vehicle using the tire winch 1032 in unwinding mode will always be less than the force required to pull the vehicle using a cable affixed bumper to bumper, as the distance traveled by the stranded vehicle will always be less than that of the towing vehicle. FIG. 3B exhibits an effectively-dimensioned unwinding spool having a spool to wheel diameter ratio of approximately 50%.

The second mode of operation is described with reference to FIG. 3B. This mode involves towing the stranded vehicle with another vehicle. As noted above, towing involves tying a rope between two vehicles and relying of the traction of the first vehicle to pull the second one. In mud, loose dirt or snow, this is not necessarily successful. The unwinding winch comes into play here in a very unique way. It is used to tow while it is unwinding. The unwinding of the cable creates a type of pulley system where distance is traded for pulling a heavy load with a smaller force. This allows the towing vehicle to gain momentum in an environment of reduced traction and apply a larger force then could be achieved by pulling with a towrope.

This may seem counter intuitive because it is a straight cable from a stuck vehicle to a towing vehicle. However, the larger diameter of the tire compared to the spool allows the towing vehicle to travel, for example, 10 feet but unwind only 8 feet of cable leaving a net of 2 feet that the stuck vehicle is pulled. The force to pull the two feet is spread out over 10 feet, reducing the load on the towing vehicle and, consequently, the required level of traction between the towing vehicle's drive wheels and the road surface.

In the previous example, the tire of the towing vehicle travels 10 feet and the spool unwinds 8 feet of rope in the same number of arbitrary revolutions. To achieve the results of that example, there would be a 4 to 5, spool to tire diameter ratio, which is illustrative of the preferred sizing of the hub of the unwinding spool. It is not that the unwinding spool hub diameter need be 80% of the tire diameter, but rather the diameter of the cable or other flexible pulling means wrapped about the hub should be such that a substantial force multiplier is achieved in unwinding. The concept of a force multiplier is basic physics: work=force× distance, and it is this concept that is the heart of the effectiveness of the unwinding winch. By pulling the towed object or vehicle a shorter distance than is traveled by the towing vehicle, you reduce the amount of work that must be performed when compared to moving the towed object or vehicle the same distance as the towing vehicle. This is why 75 ft/lbs of torque exerted by the wheel of a towing vehicle with a spool providing a 4 to 1 mechanical advantage will effectively exert 300 ft/lbs upon the towed object or vehicle, which travels only 10 feet. As can be seen by this example, the spool diameter affects both the pulling force required and the pulling distance; i.e. as the diameter of the spool increases, the force that a first car requires to pull a second car decreases and the distance that the first car must travel increases.

Figure 18:
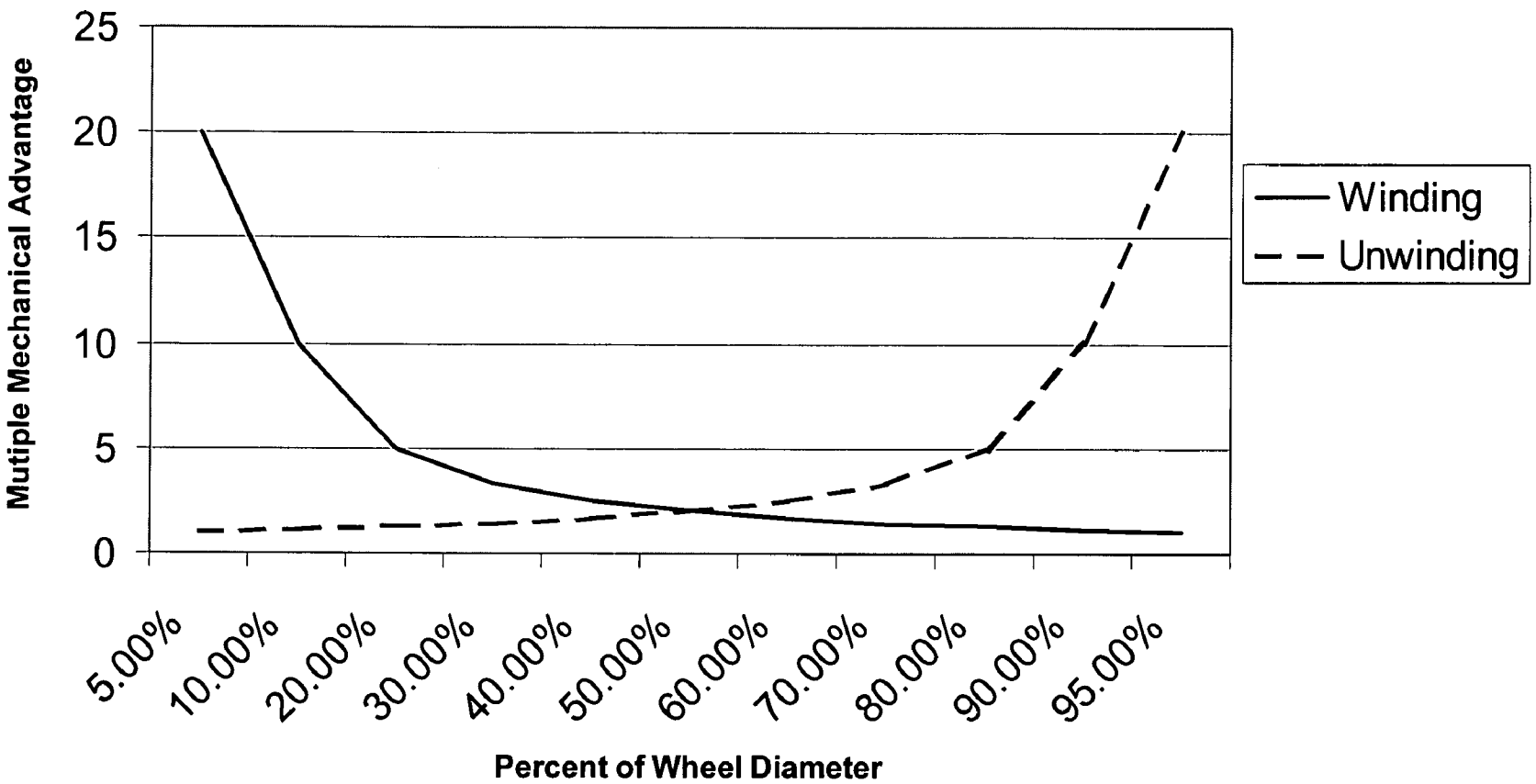
FIG. 18 is a graph showing the mechanical advantage as a function of hub diameter in winding versus unwinding.
Figure 19:
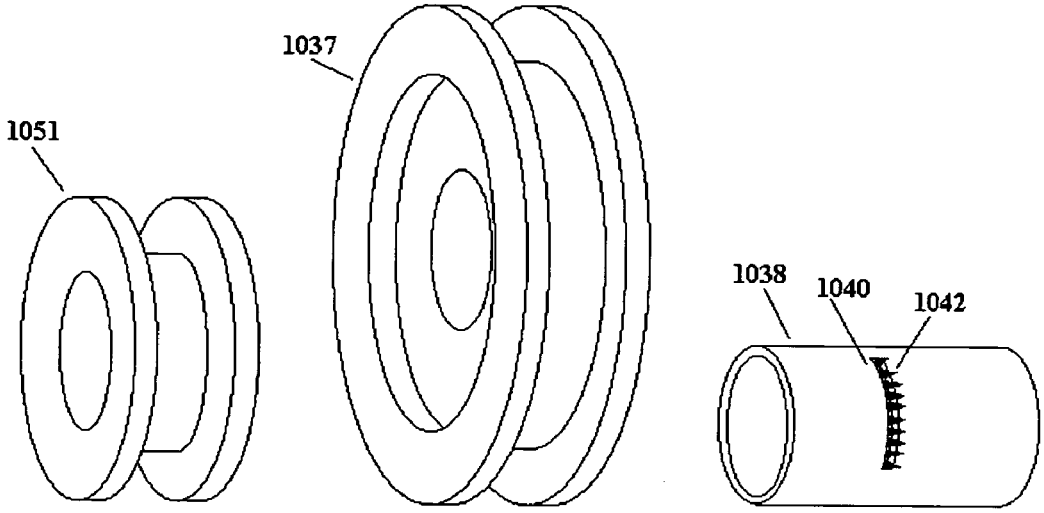
FIG. 19 is an isometric view of the three parts of the preferred kit of the present invention in disassembled form.

FIG. 18 shows in greater detail how the spool size correlates to mechanical advantage in the two modes of operation; i.e. winding and unwinding. In unwinding embodiments, spool hubs having a larger diameter as a percentage of tire diameter provide a higher mechanical advantage, as the length of the pulling member that is unwound per revolution is greater than that of smaller diameter hubs and, consequently, is closer to the distance actually traveled by the towing vehicle. Thus, the distance that the towed object or vehicle travels is shorter and the torque transmitted through the pulling member is effectively multiplied. Conversely, in unwinding applications, the smaller the hub diameter, the smaller the distance traveled and the higher the force multiplier. This is the reason that all prior art tire winches utilize relatively small hub diameters, and it one of the principal difference between the present invention and those prior art tire winches described above.

FIG. 3B shows the unwinding spool embodiment sporting an effectively-dimensioned unwinding spool design. When discussing the present invention, effectively-dimensioned spools are best characterized relative to a corresponding tire size. A corresponding tire is a tire upon which the system of the present invention is set to mount. The sizes of either the winding spool embodiments or the unwinding spool embodiments are termed 'effective' in consideration of the balance between pulling force, pulling distance, vehicle type and wheel traction. In principle, the present invention equipped with a spool of any size less than the tire size confers an advantage to displacing an object in either winding or unwinding. However, an embodiment of the present invention supplying merely a slight, say 1.1, mechanical advantage probably is not helpful in most circumstances, as it is merely slightly more advantageous than no system at all. Similarly, an embodiment of the present invention that confers an enormous, say 50:1, mechanical advantage due to spool size, yet requires scores of yards to budge an object is only advantageous in large open fields—a rare occurrence. After all, only a finite amount of line, rope, cable or the like can attach to the spool. Likewise, the type of vehicle and the conditions of the surface contacted by the wheels of the towing vehicle are also considerations in the effectiveness of the spool size. A heavy vehicle, having a powerful engine and relatively better traction, does not require as high of a mechanical advantage as a light vehicle does. Similarly, a smaller mechanical advantage may be effective in circumstances where the surface contacted by the wheels of the towing vehicle is sufficient to provide good traction.

Although it is recognized that the above referenced variables will contribute to the overall effectiveness of the system, for purposes of the present invention, an effectively sized spool will provide an average minimum of a 2:1 mechanical advantage. Thus, in single spool embodiments for use in winding or unwinding, the spool is preferably dimensioned to be approximately 50% of the diameter of the tire, while those embodiments in which different spools are provided for winding and unwinding, the spools will be less than 40% of tire diameter and greater than 40%, respectively due to the fact that the winding of the cable will increase the diameter, resulting in an average actual pulling diameter of between 40% and 60%.

The unwinding winch embodiments possess an important inherent safety feature, among others. When unwinding, the location of the rope or strap is underneath the axis of the rim. This is safer position then a winding winch could be relative to a vehicle. Winding winch embodiments might need a "rope guides" or the like to keep a towing line away from a car body. The unwinding winch is inherently below the body.

Figure 5:
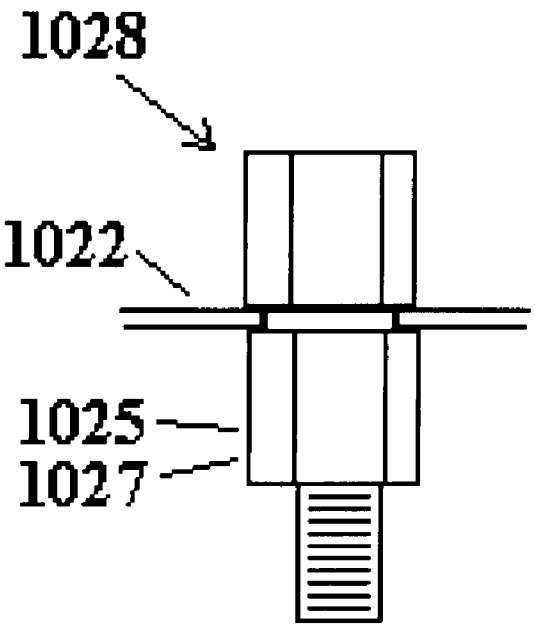
FIG. 5 is a cut away top view of the spool, mounting lugs and lug nuts in a fully assembled position
Figure 4:
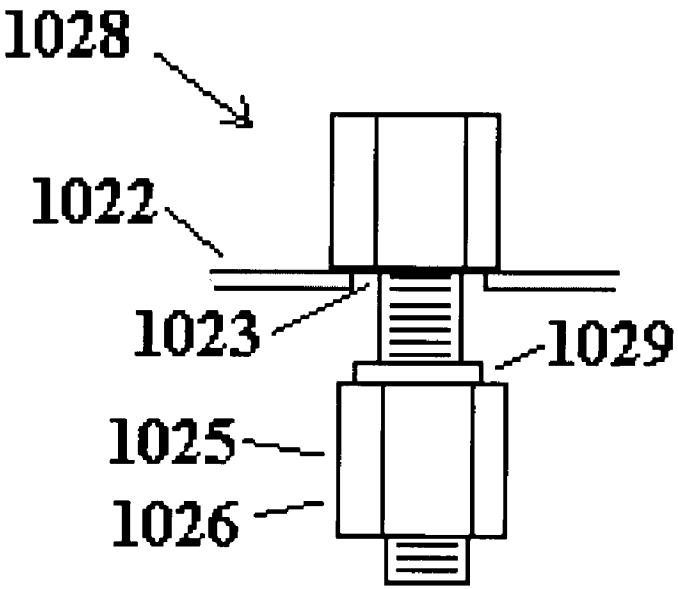
FIG. 4 is a cut away top view of the spool, mounting lugs and lug nuts in a partially assembled position.

Referring now to FIGS. 4 and 5, the preferred lug nut arrangement for attachment of the spool is shown. In this embodiment, the holes 1023 in the central portion 1022 of the winch 1032 are slightly larger then the tire lugs 1050 and lug nut 1025 has a lip 1029 dimensioned to mate with the oversized holes 1023. As shown in FIG. 5, when assembled, this arrangement will keep the bracket from resting on the lugs 1027.

Figure 6:
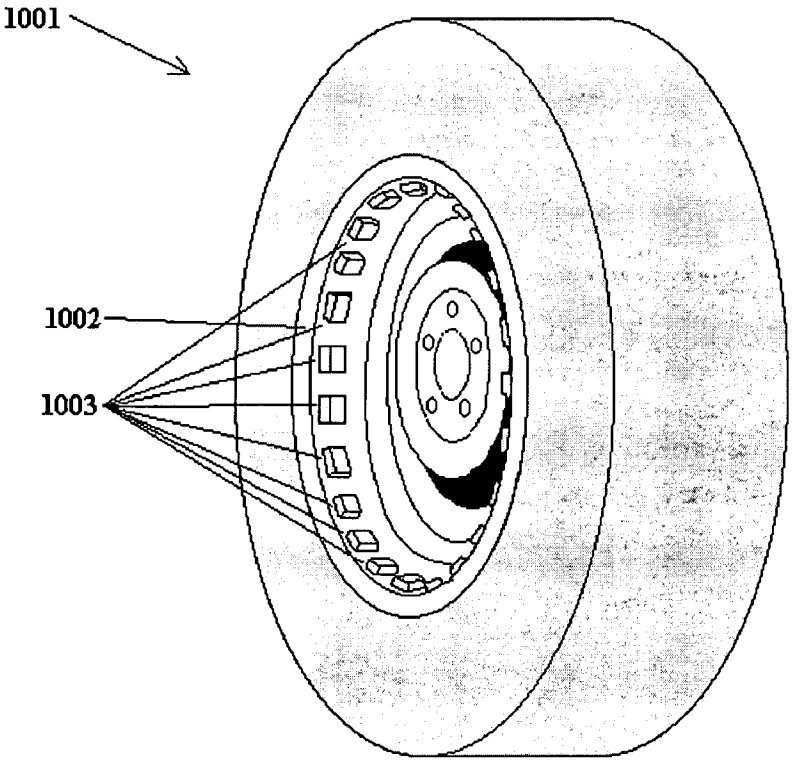
FIG. 6 is an isometric view of a tire and tire rim in accordance with one embodiment of the system of the present invention

Referring now to FIGS. 6–10, one quick connect embodiment of the tire winch system is shown. FIG. 6 shows a tire 1001 with a specialized rim 1002 that has blocks 1003 that formed about the outer surface of the rim 1002. These blocks 1003 are dimensioned and disposed upon the rim 1002 so as to mate with the spools 1004, 1014 of FIG. 7.

Figure 7:
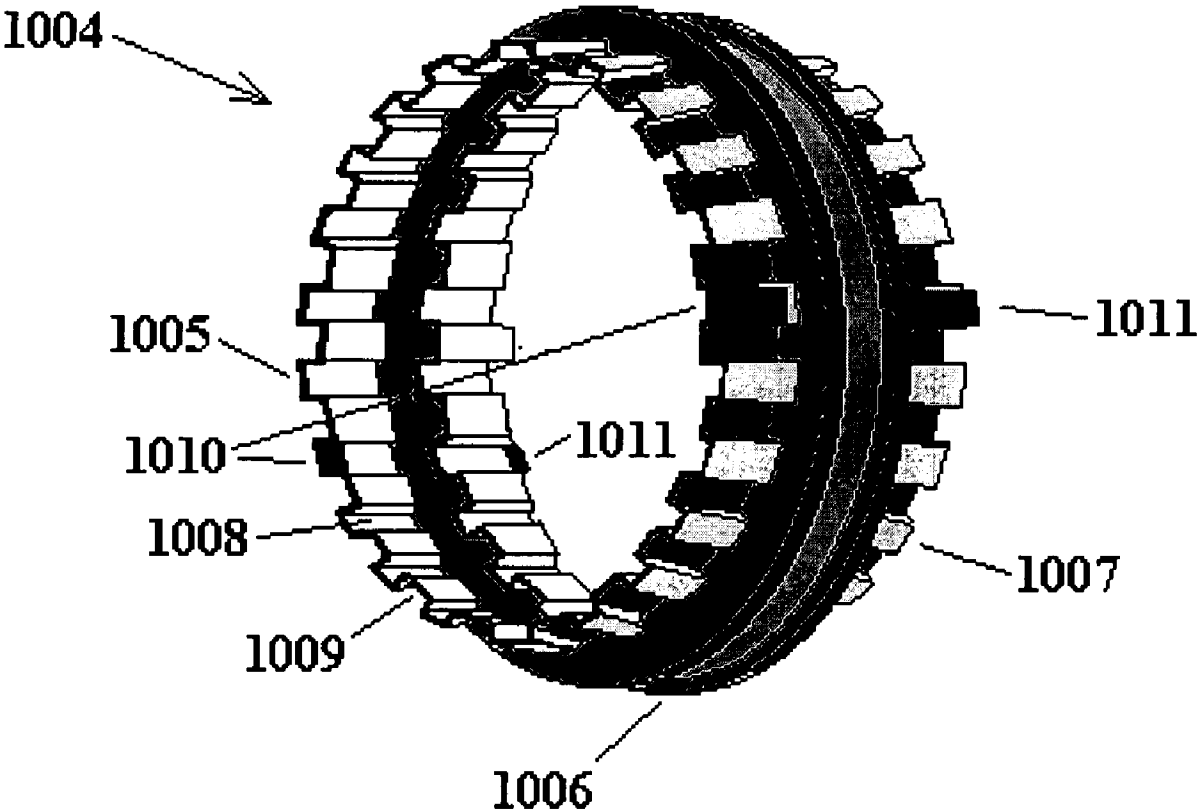
FIG. 7 is an isometric view of one embodiment of a spool.
Figure 8:
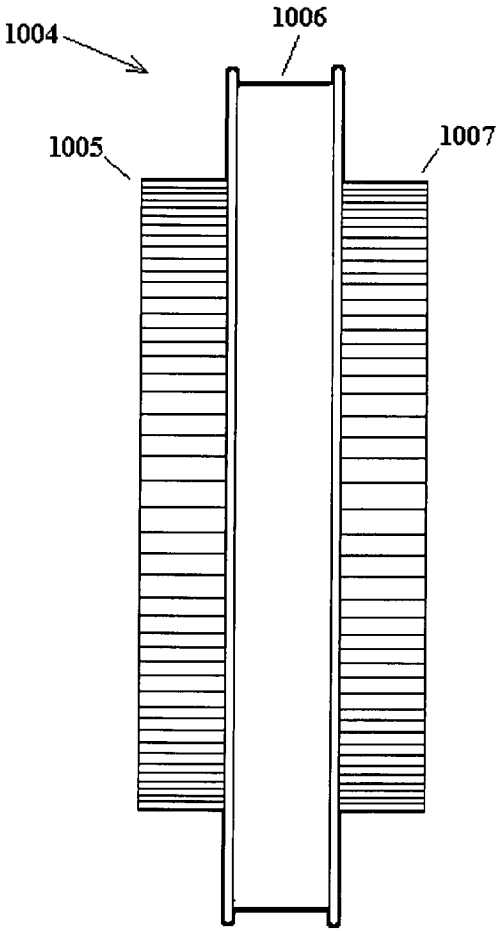
FIG. 8 is a front view of the spool of FIG. 7.

The spool 1004 of FIGS. 7 & 8 has three parts, two toothed sections 1005, 1007 and a hub 1006 sandwiched between the toothed sections 1005, 1007. The toothed sections 1005, 1007 each have an inner surface 1008 and an outer surface 1009. The inner surfaces 1008 of toothed sections 1005, 1007 are designed to slide onto a receiving bracket 1010 in the manner shown and described with reference to FIGS. 10–12, while the outer surfaces 1009 are designed to slide on to the receiving tire rim 1002 of FIG. 6 in the manner shown in FIG. 9.

It is preferred that the spool 1004 in these embodiments include two toothed sections 1005 and 1007 as this allows the spool 1004 to be mounted to either side of the vehicle, or used in winding or unwinding mode, without having to unwind the cable (not shown) and rewind it in a different direction. However, it is recognized that other spools may include a single toothed section 1005 that is dimensioned to mate with mating details on the rims of tires on either side of a vehicle. Similarly, the spool 1004 of these embodiments preferably includes a plurality of toothed sections 1005, 1007, as this more evenly distributes the forces transferred from the spool 1004 to the tire 1001. However, it is likewise understood that spools having only two or more teeth or other details dimensioned to mate with details on, or attached to, the rim of the tire 1001 may be substituted to achieve similar results.

Figure 9:
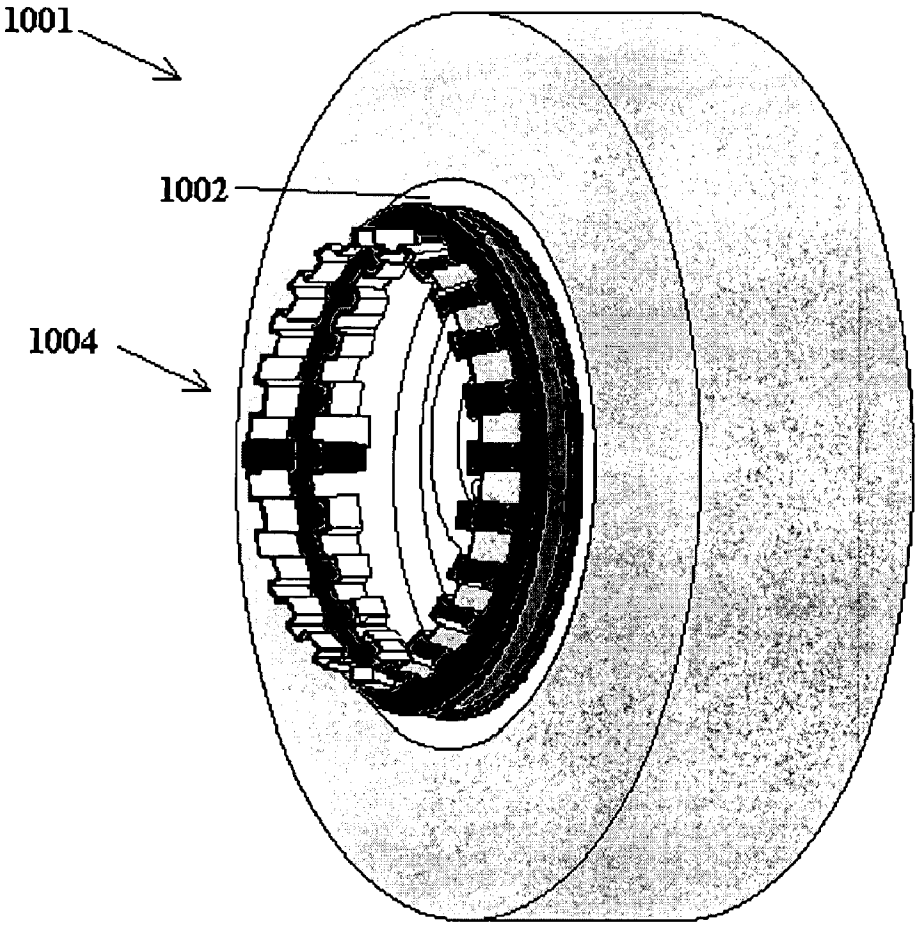
FIG. 9 is an isometric view of the spool attached to the tire rim of FIG. 6

In the system of FIGS. 6–10, it is preferred that clips 1011 be used to secure spools 1004 to the tire. These clips 1011 are preferably hand-operated spring clips designed for quick attachment and quick release, with the tension of the spring action being calibrated to allow the clip to release if there is too much load placed on the tire. FIG. 7 shows these clips 1011 on the outer surface 1009 of the spool 1004, which is applicable to outside mount embodiments, such as those of FIGS. 10-12. However, as shown in FIG. 9, these clips 1011 are mounted on the inner surface 1008 of the spool 1004 when utilized with the rim 1002 of FIG. 6. Although clips are preferred, it is understood that other art recognized retaining details, such as set screws, pins or the like, may be utilized to achieve similar results.

FIG. 8 shows an end view of the preferred spool 1004 for use with these embodiments. Because of its similarity in shape to that of standard tire rims, it is preferred that this spool 1004 be manufactured using the same low cost steel pressing methods common in the rim industry. However, the spool 1004 may be cast, machined or manufactured using a combination of art-recognized process to achieve similar results.

Figure 10:
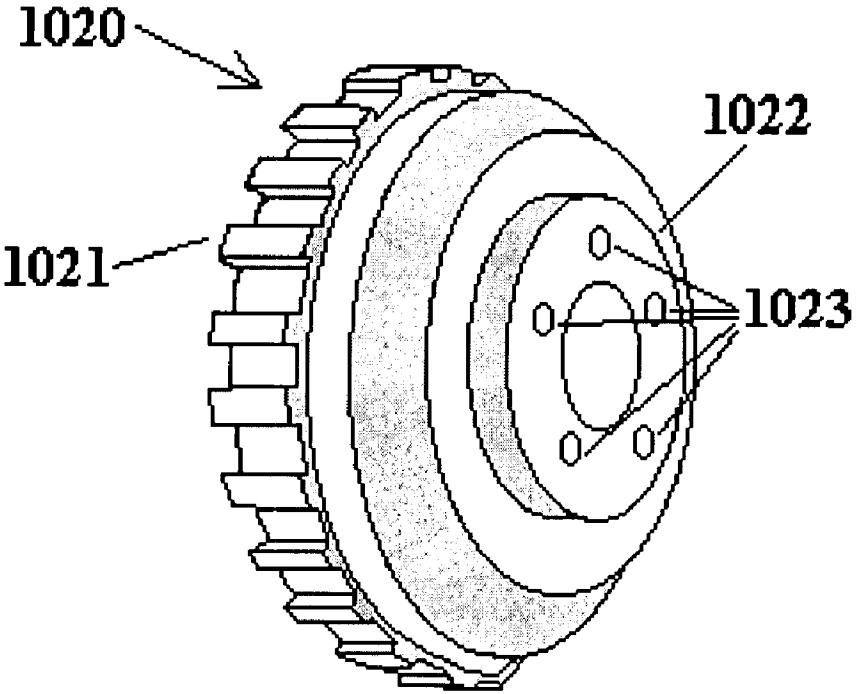
FIG. 10 is an isometric view of a hub-mounted bracket for receiving a spool.
Figure 11:
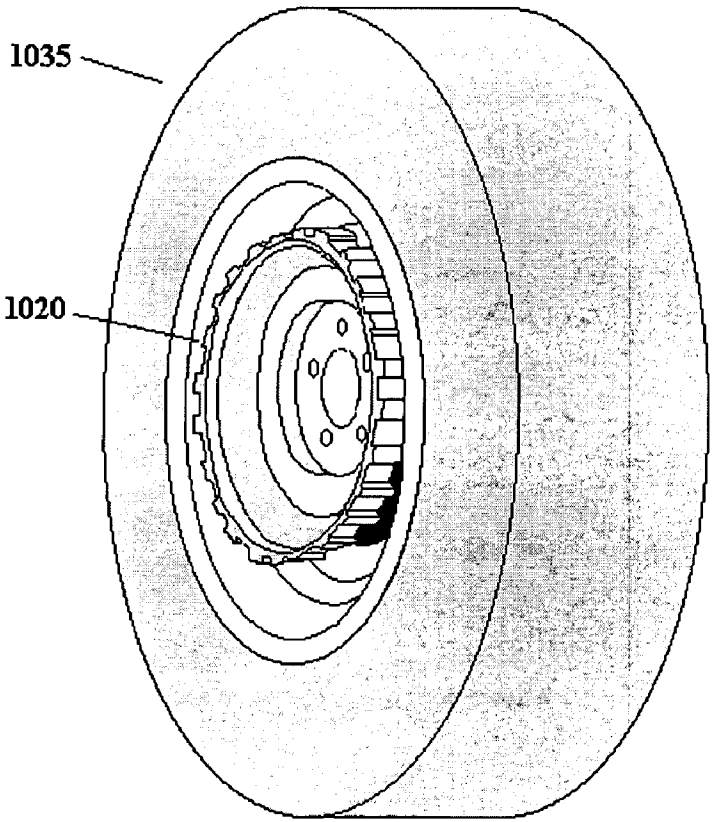
FIG. 11 is an isometric view of a hub-mounted bracket attached to a hub
Figure 12:
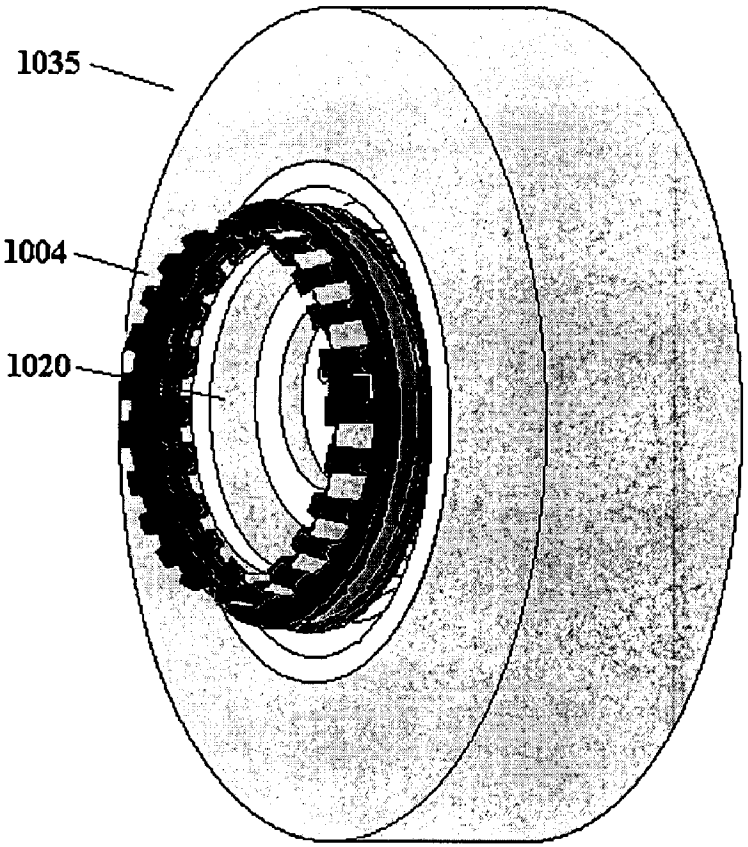
FIG. 12 is an isometric view of a spool attached to the hub-mounted bracket of FIG. 11.

FIGS. 10–12 show another embodiment of the tire winch system having a quick disconnect means. FIG. 10 shows a hub-mounted bracket 1020 for receiving the spool 1004 of FIG. 7. The hub mounted bracket 1020 mounts to the tire as shown in FIG. 11, in a manner similar to the tire winch 1032 of FIG. 1. However, rather than having a rim 1006 integral thereto, the bracket 1020 has a plurality of teeth 1021, which are dimensioned to mesh on the inside of teeth 1005, 1007 in the manner demonstrated in FIG. 12. The elimination of the rim 1006 from the bracket 1020 allows the bracket to sit flush, or nearly flush, with the outside of the tire 1001. This enables a user to affix the bracket 1020 to the tire and leave it there during normal driving, allowing the user to achieve the same quick disconnect advantages of the embodiment of FIGS. 6–9 without having to purchase specialized rims.

FIGS. 13–17 show the preferred embodiment of the present invention, which is equipped with a torque as a safety means for either the winding or unwinding version of the present invention. The torque-limiting means operates analogously to a torque wrench. The preferred torque-limiting means employs a ratchet that has the ability to set a given torque limit for the tire, which limits the amount of force applied to the tire head over a given distance (from the hub of the winding system to the center of the tire). In operation, the torque-limiting means disengages the spool from the central portion and rotates freely when the force on the tire reaches a torque limit preset by either a manufacturer or a user.

Figure 13:
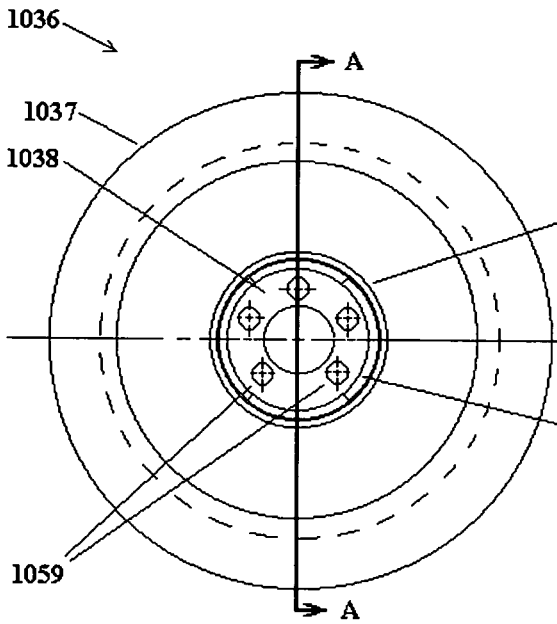
FIG. 13 is a front view of one embodiment of the tire winch of the present invention having a torque-limiting means
Figure 14:
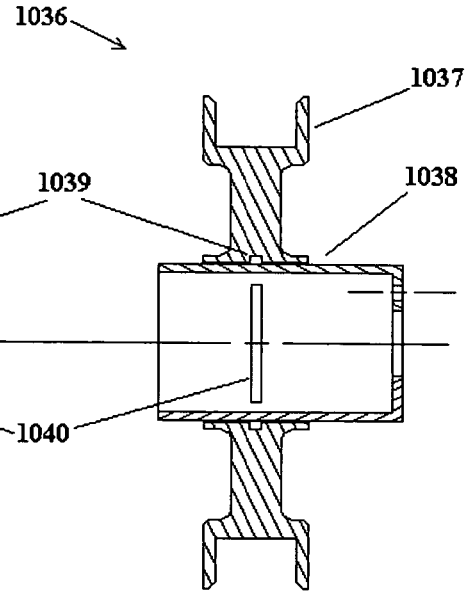
FIG. 14 is a side cross-sectional view of the embodiment of FIG. 13 along line A—A.
Figure 15:
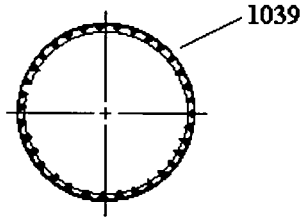
FIG. 15 is an internal cross-sectional view of the ratcheting spool of the embodiment of FIG. 13.

FIGS. 13 and 14 exhibit a torque-limiting means embodiment with a cylindrically shaped central portion 1022. Between the central portion 1022 and the spool 1037, one or more slots 1040 and a channel 1039 are adapted to correspond in the same plane of rotation. FIG. 15 displays the preferred toothed internal arrangement of the channel 1039. A series of teeth 1054 project from the depths of the channel and extend approximately to the height of the channel.

Figure 16:
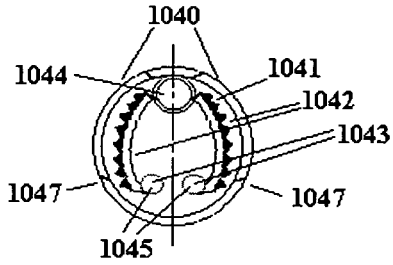
FIG. 16 is an internal cross-sectional view of the ratcheting hub of the embodiment of FIG. 13 in a disengaged position.

FIG. 16 shows in greater detail the preferred internal mechanisms of the central portion 1022 of the torque-limiting means that mate with the toothed channel 1039. Beneath each slot 1040 is a tension-controlling ratchet 1041 comprised of two spring-loaded toothed fingers 1042. The toothed fingers 1042 engage the toothed channel 1039 exhibited in FIG. 15. One side of each finger is mounted on a stationary spring 1044 while a distant portion of each finger is compressed by a finger loop 1043. When confronted by torsion in excess of a limit determined by the combined tolerance of the spring and finger loops within, the toothed fingers 1042 will remain in position 1045, a disengaged position.

Figure 17:
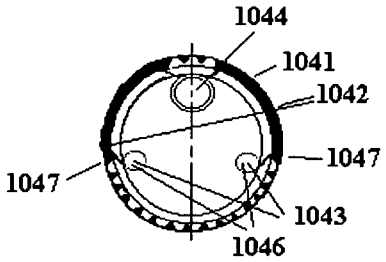
FIG. 17 is an internal cross-sectional view of the ratcheting hub of the embodiment of FIG. 13 in an engaged position.

FIG. 17 shows the toothed fingers 1042 released to an engagement position 1046. This is the locking position through the slot 1040 of the central portion 1022 into the toothed channel 1039 of the spool 1037. In operation, the teeth are the power transfer point of torsion from the central portion 1022 to the spool. The tension on the spring and finger loops determines the amount of force that the fingers

1042 can resist. Beyond a certain point, the teeth will slip causing the central portion to disengage the spool. The design of the fingers will direct the torsion against the leading edges 1047 of the slots in the hub. Because of this, the spring does not hold the full torsion force. When the torsion is beyond the design limit, the fingers will slip out of the channel teeth and ratchet to the next tooth. In extreme circumstances, a rigid object may be placed in the interior of the central portion to brace the toothed fingers to prevent disengagement. Alternatively, this simple ratchet system can also be accomplished with a friction surface, instead of teeth, that slips from excessive force.

Referring now to FIGS. 19–21C, the preferred kit of the present invention is shown. The preferred kit includes two spools 1037, 1051 and an attachment means 1038 that is dimensioned to attach either of the spools 1037, 1051 to a tire. The first spool is a winding spool 1051 that is dimensioned to have a diameter that is less than 40% of the diameter of the tire. The second spool is an unwinding spool 1037 that is dimensioned to have a diameter that is greater than 40% of the diameter of the tire. In the preferred kit, the attachment means 1038 is a substantially hollow cylinder dimensioned to mate with cylindrical channels through each of the spools 1037, 1051 and a plurality of bolt holes (shown in FIGS. 21A–C) for mating with the lugs of a tire wheel. The preferred attachment means 1038 also has fingers 1040, 1042 disposed about its outer surface to mate with the channel 1039 and teeth 1054 that project from the depths of the within the spools 1037, 1051, which operate in a manner similar to those described with reference to FIGS. 13–17. However, this is not required, and the spools 1037, 1051 may be affixed to the attachment means 1038 using a keyway and slot, set screw, or other art recognized means for securing a gear to a shaft.

Figure 20:
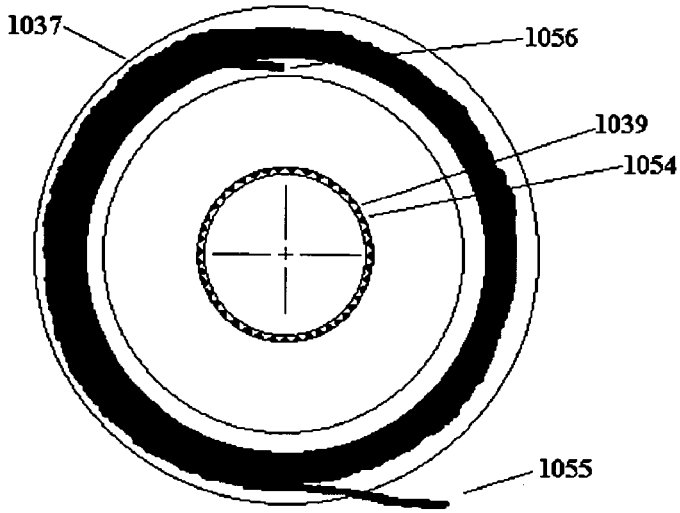
FIG. 20 is a cut away side view of the kit of the present invention with the preferred strap attached to the unwinding spool.

As shown in FIG. 20, the preferred embodiment of the kit includes the flexible pulling member 1055. It is preferred that this pulling member be a flexible strap 1055 that winds over itself and is secured by the frictional contact of one wind of the strap 1055 onto another. This is preferred as using a flat strap with the present invention allows a longer length of flexible pulling member to be placed about the outer hub, although it is noted that the length of strap shown in FIG. 20 has been significantly reduced from the preferred length for ease of drawing. As a greater distance of pulling member can be placed on the outer hub, the spool can be sized to increase the mechanical advantage of a particular embodiment. However, as noted above, it is recognized that ropes, cables or other flexible pulling members that are sufficiently flexible to wrap about the hub and sufficiently strong to handle the loads placed upon the member by the system, may be utilized. In some embodiments of the kit, a carrying case and instructions for use are likewise provided.

In the embodiment of FIG. 20 the unsecured wrapping of the wrapping provides an additional safety feature; i.e. the end of the strap is not securely anchored to the outer hub. The strap, or other such line, relies on pulling force generated by the tire to compress the line to the outer hub. Frictionally, the strap is held as it unwinds until the number of wraps left cannot hold the remainder of the strap onto the outer hub, then the strap uncoils. The unraveled strap does not whip back. Embodiments may additionally use an adhesive hook-and-loop system such as VELCRO to hold a portion of a strap to an outer hub. A portion of hook-and-loop fastener would be placed on the strap and a mating portion of hook-and-loop fastener would be placed on the outer hub.

Additionally, the present invention may utilize snap straps as safety means. These snap straps are straps comprised of a material and density that only tolerates force up to a certain range. For instance, snap straps having a tolerance of 500 pounds break as the force generated in the winding or unwind process exceeds 500 pounds. The snap straps assist in preventing wheels equipped with the present invention from straining under intolerable forces.

Figure 21A:
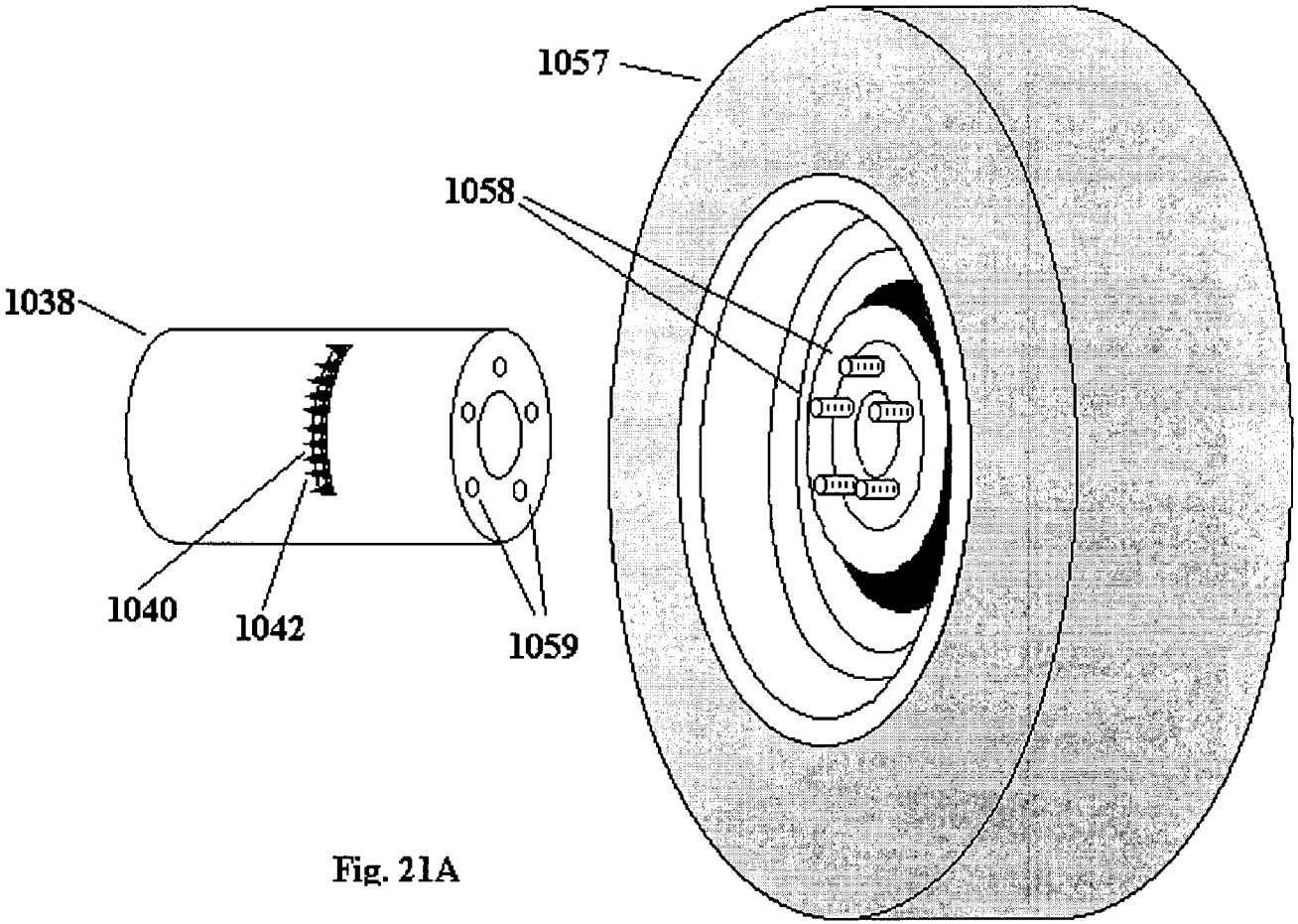
FIG. 21A is an isometric view of a wheel and tire and the attachment means of the preferred kit in position for attachment to the wheel lugs.
Figure 21B:
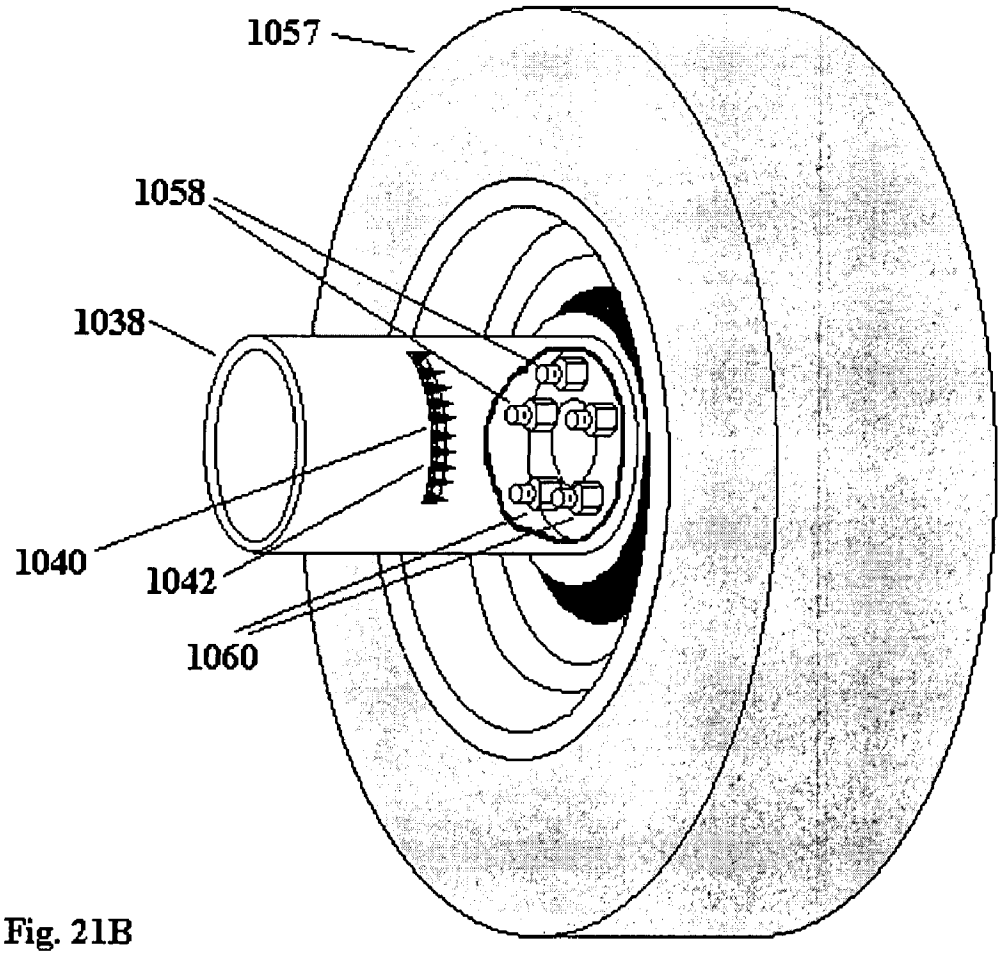
FIG. 21B is an isometric view of a wheel and tire with the attachment means of the preferred kit attached to the wheel lugs.
Figure 21C:
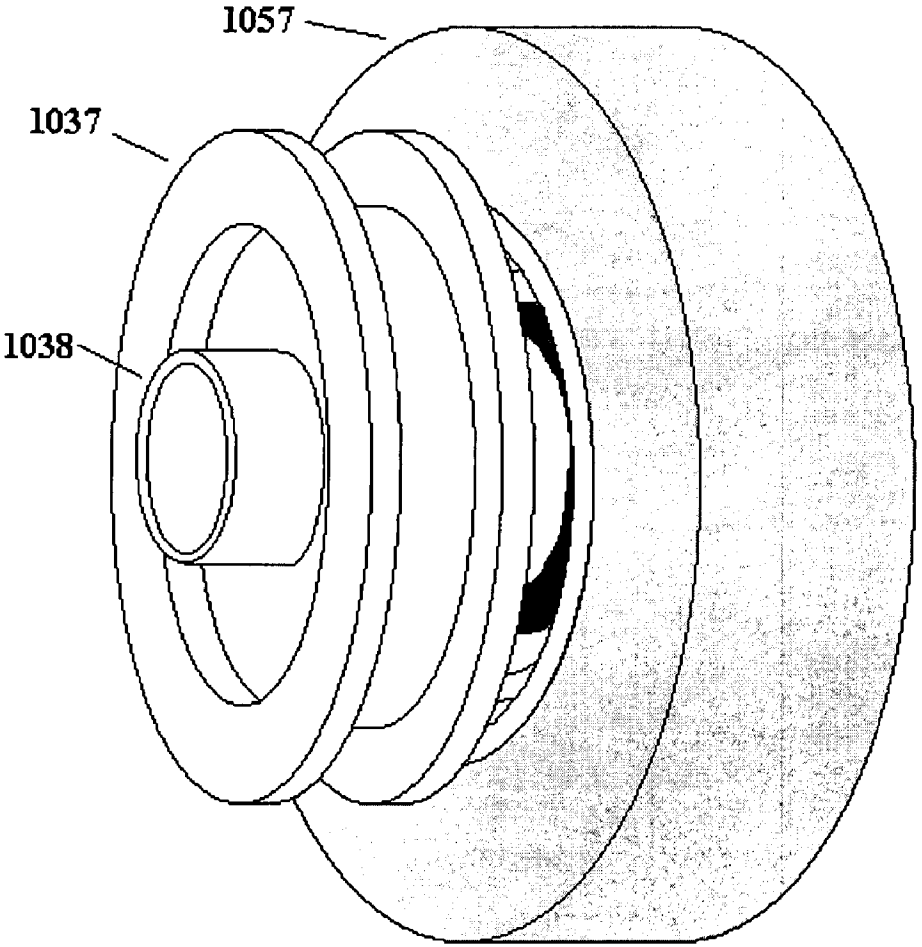
FIG. 21C is an isometric view of a wheel and tire with the attachment means of the preferred kit attached to the wheel lugs and the unwinding spool attached to the attachment means.

As shown in FIGS. 21A–21C, the kit of the present invention is attached to the drive wheel 1057 of the vehicle by first aligning the bolt holes 1059 in the attachment means 1038 with the lugs 1058 of the wheel 1057. The attachment means 1038 is then placed over the lugs 1058 and secured thereto by lug nuts 1060 in a conventional manner. Finally, the desired spool 1037, 1051, here the unwinding spool 1037, is slid over the attachment means 1038 until it the internal ratcheting details (not shown) mate with the fingers 1040, 1042 on the outside surface of the attachment means 1038, effectively locking it into place.

Another embodiment of the present invention utilizes a pulley. This, with the end of the strap connected back to the vehicle, will cut the distance the pulley can travel in half, but double the amount of work it will perform. An example is a tractor with a pulley on the strap and connected to the drawbar. A chain connected to the pulley could be wrapped around a stump. The tractor would be amplifying the work it can accomplish by trading distance for force.

Although the present invention has been described in considerable detail with reference to certain preferred versions thereof, other versions would be readily apparent to those of ordinary skill in the art. Therefore, the spirit and scope of the appended claims should not be limited to the description of the preferred versions contained herein.

What is claimed is:

1. A tire winch for attachment to a vehicle tire, said tire winch comprising:

a spool having a substantially cylindrical hub;

a means for attaching said spool to the vehicle tire such that a rotation of the vehicle tire causes a first point on said spool to rotate about an arc that is substantially equal to an arc rotated by a second point on said vehicle tire; and a torque-limiting means for causing said first point on said spool to rotate about an arc that is substantially less then an arc rotated by a second point on said vehicle tire when a torque exerted upon said spool exceeds a predetermined limit, wherein said torque-limiting means comprises a ratchet mechanism.

2. The tire winch as claimed in claim 1 wherein said hub is dimensioned such that an outer diameter of said hub is at least 40% of an outer diameter of the vehicle tire.

3. A tire winch kit for attachment to a vehicle tire, said tire winch kit comprising:

an unwinding spool comprising a substantially cylindrical hub having an outer diameter that is at least 40% of an outer diameter of the vehicle tire;

a winding spool comprising a substantially cylindrical hub having an outer diameter that is less than 40% of an outer diameter of the vehicle tire; and a means for attaching one of said unwinding spool and said winding spool to the vehicle tire such that a rotation of the vehicle tire causes a first point on said spool to rotate about an arc that is substantially equal to an arc rotated by a second point on said vehicle tire.

4. The tire winch kit as claimed in claim 3 further comprising a flexible pulling member dimensioned for attachment to said outer diameter of said hub.

5. The tire winch system as claimed in claim 3 wherein said flexible pulling member is a strap.

6. The tire winch kit as claimed in claim 3 wherein said means for attaching one of said unwinding spool and said winding spool to the vehicle tire comprises a plurality of blocks extending from an outer surface of a rim of said tire, and wherein each of said winding spool and said unwinding spool comprise a plurality of toothed sections dimensioned to mate with said plurality of blocks.

7. The tire winch kit as claimed in claim 6 further comprising a plurality of clips dimensioned to secure one of said winding spool and said unwinding spool to said tire.

8. The tire winch kit as claimed in claim 3 wherein said means for attaching one of said unwinding spool and said winding spool to the vehicle tire comprises a hub mounted bracket comprising a plurality of holes disposed and dimensioned to mate with a plurality of lugs of said vehicle tire and a plurality of teeth, and wherein each of said winding spool and said unwinding spool comprise a plurality of toothed sections dimensioned to mate with said plurality of teeth of said hub mounted bracket.

9. The tire winch kit as claimed in claim 8 further comprising a plurality of clips dimensioned to secure one of said winding spool and said unwinding spool to said tire.

10. The tire winch kit as claimed in claim 3 further comprising a torque-limiting means for causing said first point on said spool to rotate about an arc that is substantially less then an arc rotated by a second point on said vehicle tire when a torque exerted upon said spool exceeds a predetermined limit.

11. The tire winch kit as claimed in claim 10 wherein said torque-limiting means comprises a ratchet mechanism.

12. A method for pulling an object, said method comprising the steps of:

attaching a tire winch comprising a spool and a hub to a drive wheel of a vehicle, wherein said hub has a diameter that is less than a diameter of a tire of said drive wheel of said vehicle;

wrapping a first end of a flexible pulling member around said hub such that only a small portion of a length of said flexible pulling member extends therefrom;

attaching a second end of said flexible pulling member to the object to be pulled;

engaging said drive wheel of said vehicle such that said vehicle moves away from said object and such that said that said flexible pulling member unwinds from said hub; and continuing said engagement of said drive wheel of said vehicle until said pulling member disengages from said hub;

whereby said object is pulled a distance that is less than a distance traveled by said vehicle.

* * * * *